US010756465B2

(12) United States Patent
Tamai et al.

(10) Patent No.: US 10,756,465 B2
(45) Date of Patent: Aug. 25, 2020

(54) ELECTRICAL CONNECTOR ASSEMBLY AND ELECTRICAL CONNECTOR FOR USE IN SAME

(71) Applicant: Hirose Electric Co., Ltd, Shinagawa-ku, Tokyo (JP)

(72) Inventors: Nobuhiro Tamai, Tokyo (JP); Shota Yamada, Tokyo (JP); Clement Kam Lam Luk, San Jose, CA (US); Jeremy Buan, San Jose, CA (US); Ching-Chao Huang, San Jose, CA (US); Tadashi Ohshida, San Jose, CA (US)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/563,671

(22) Filed: Sep. 6, 2019

(65) Prior Publication Data

US 2020/0083622 A1 Mar. 12, 2020

(30) Foreign Application Priority Data

Sep. 7, 2018 (JP) ..... 2018-167964

(51) Int. Cl.
*H01R 13/64* (2006.01)
*H01R 12/71* (2011.01)
*H01R 13/6473* (2011.01)

(52) U.S. Cl.
CPC ..... *H01R 12/716* (2013.01); *H01R 13/6473* (2013.01)

(58) Field of Classification Search
CPC ... H01R 13/6473; H01R 13/26; H01R 12/716
See application file for complete search history.

(56) References Cited

U.S. PATENT DOCUMENTS

| | | | | |
|---|---|---|---|---|
| 8,465,302 | B2 * | 6/2013 | Regnier | H01R 9/038 439/108 |
| 2011/0067237 | A1 * | 3/2011 | Cohen | H01R 13/28 29/857 |
| 2012/0202395 | A1 * | 8/2012 | Gailus | H01R 13/26 439/889 |
| 2014/0057494 | A1 * | 2/2014 | Cohen | H01R 13/04 439/626 |
| 2018/0048094 | A1 * | 2/2018 | Cornelius | H01R 13/6473 |

FOREIGN PATENT DOCUMENTS

JP 6198712 B2 9/2017

* cited by examiner

*Primary Examiner* — Xuong M Chung Trans
(74) *Attorney, Agent, or Firm* — Procopio, Cory, Hargreaves & Savitch LLP

(57) ABSTRACT

The first terminals have contact arm portions extending in a rectilinear manner in the direction of connector plugging and unplugging; the second terminals have convex contact point portions contactable with an intermediate portion of the contact arm portions in the same direction. When the stub portions of the contact arm portions are divided into a free end side range and a proximal end side range such that the center point of said stub portions in the direction of plugging and unplugging forms a boundary, in the arranged state of the first terminals, impedance at arbitrary locations in the direction of plugging and unplugging within the free end side range is larger than impedance at arbitrary locations in the plugging direction within the proximal end side range.

20 Claims, 6 Drawing Sheets

(A)

(B)

ELECTRICAL CONNECTOR ASSEMBLY AND ELECTRICAL CONNECTOR FOR USE IN SAME

CROSS-REFERENCE TO RELATED APPLICATIONS

This application claims priority to Japanese Patent Application No. 2018-167964, filed Sep. 7, 2018, the contents of which are incorporated herein by reference in its entirety for all purposes.

BACKGROUND

Technical Field

The present invention relates to an electrical connector assembly and an electrical connector for use in the same.

Related Art

A variety of shapes are considered for the terminal contact portions placed in mutual contact when a pair of electrical connectors are mated. For example, a connector assembly in which mutual contact is established using rectilinear plug terminals that are not subject to resilient displacement and in which receptacle terminals are brought into contact with said plug terminals as a result of undergoing resilient displacement has been disclosed in the connector of Patent Document 1. The electrical connector assembly of this Patent Document 1 has a plug connector used as a connector for circuit boards and a receptacle connector used as another connector for circuit boards. The multiple terminals retained in place in array form in the plug connector are rectilinear plug terminals extending in the direction of connector plugging and unplugging, and the multiple terminals retained in place in array form in the receptacle connector are resiliently displaceable receptacle terminals. After undergoing resilient displacement and sliding under contact pressure from the above-mentioned plug terminals in the process of connector mating, said receptacle terminals come into contact with the above-mentioned plug terminals while maintaining the state of resilient displacement.

In the above-mentioned plug terminals, the sections that extend from the distal ends (free ends) on the connector mating side to an intermediate location are formed as contact arm portions that are capable of contacting the above-mentioned receptacle terminals. The specific shape of said contact arm portions is unknown, as no detailed description is provided. On the other hand, the above-mentioned receptacle terminals have protruding contact portions (convex contact point portions) formed in their distal end portions on the connector mating side, with said convex contact point portions adapted to come into contact with said contact arm portions at an intermediate location in the longitudinal direction of the above-mentioned contact arm portions. Configuring a longer effective mating length, i.e., a greater distance from the location of contact with the convex contact point portions of the receptacle terminals to the distal ends (free ends) of the plug terminals, ensures a reliable state of contact independently of the mating depth of the two connectors.

RELATED ART DOCUMENT

Patent Documents

[Patent Document 1]
Japanese Patent No. 6,198,712.

SUMMARY

Problems to be Solved

However, the section of the plug terminals representing the above-mentioned effective mating length, that is, the distance from the location of contact with the convex contact point portions of the receptacle terminals to the distal ends (free ends) of the plug terminals, is referred to as a "stub." When pairs of terminals are connected for transmission of high-speed signals, the transmitted signals may sometimes be reflected by said stubs and thus create resonance. As a result, there is a risk of degradation in the quality of high-speed signal transmission, e.g., the transmitted signals be may be weakened.

It is known that if the above-mentioned stubs are made longer, the frequency of the resonance-generating signal tends to become lower. On the other hand, if the above-mentioned stubs are made shorter, the frequency of the resonance-generating signal becomes higher and, for this reason, the effects of the above-mentioned resonance on the signal are reduced. However, the stability of contact is diminished because of the shorter effective mating length. In other words, the requirement of ensuring a sufficient effective mating length is in conflict with the requirement of minimizing degradation in the quality of high-speed signal transmission by making the stubs shorter.

In view of such circumstances, it is an object of the present invention to provide an electrical connector assembly and an electrical connector capable of adequately minimizing degradation in signal transmission quality while ensuring a sufficient effective mating length.

Technical Solution

It is an object of the present disclosure to provide an electrical connector assembly and an electrical connector capable of adequately minimizing degradation in signal transmission quality while ensuring a sufficient effective mating length.

The inventors have found that when, during transmission of signals by bringing terminals having rectilinear contact arm portions into contact with terminals having convex contact point portions, the stub portions of the above-mentioned contact arm portions, in other words, the sections extending in the direction of connector plugging and unplugging from the location of contact with the above-mentioned convex contact point portions to the free ends of said contact arm portions, are divided into a free end side range and a proximal end side range such that the center point in said direction of plugging and unplugging forms a boundary therebetween, and the relationship of impedance magnitudes at arbitrary locations of the respective ranges in the above-mentioned direction of plugging and unplugging affects the relative magnitude of the frequency of the signal that generates resonance in the above-mentioned stub portions. Specifically, if impedance at arbitrary locations in the above-mentioned free end side range is greater than impedance at arbitrary locations in the above-mentioned proximal end side range, the frequency of the signal that generates resonance in the stub portions becomes higher and the transmitted signal becomes less susceptible to influence. Said impedances will fall and rise depending on the ambient environment of the above-mentioned stub portions, such as depending on the opposed surface area and distance between them and metal members located around the periphery of the stub portions.

In the present invention, the shape and placement of the terminals are determined by taking this relationship of impedance magnitudes into consideration with a view to satisfying the two conflicting requirements of ensuring effective mating length and minimizing degradation in signal transmission quality.

In accordance with the present invention, the above-described problem is solved using an electrical connector assembly according to a first invention and an electrical connector according to a second invention as shown below.

<First Invention>

The electrical connector assembly according to the first invention has a first electrical connector and a second electrical connector connected in a manner permitting plugging into and unplugging from each other.

Such an electrical connector assembly according to the first invention is characterized in that the above-mentioned first electrical connector has multiple first terminals arranged such that their array direction is a direction perpendicular to the direction of plugging and unplugging into/from the above-mentioned second electrical connector; said first terminals, in their free end portions located on the connector mating side, have contact arm portions extending in a rectilinear manner in the above-mentioned direction of plugging and unplugging; the above-mentioned second electrical connector has multiple second terminals arranged in the same direction as the array direction of the above-mentioned first terminals; said second terminals, in their free end portions located on the connector mating side, have convex contact point portions contactable with the intermediate portions of the above-mentioned contact arm portions of the above-mentioned first terminals in the above-mentioned direction of plugging and unplugging; and, when stub portions in the contact arm portions of the above-mentioned first terminals, which extend in the above-mentioned direction of plugging and unplugging from the location of contact with the convex contact point portions of the above-mentioned second terminals to the free ends of said contact arm portions, are divided into a free end side range and a proximal end side range such that the center point of said stub portions in the above-mentioned direction of plugging and unplugging forms a boundary therebetween, in the arranged state of the above-mentioned first terminals, impedance at arbitrary locations in the above-mentioned direction of plugging and unplugging within the free end side range is larger than impedance at arbitrary locations in the above-mentioned direction of plugging and unplugging within the proximal end side range.

According to the first invention, in the stub portions of the first terminals of the first connector, impedance at arbitrary locations in the above-mentioned direction of plugging and unplugging within the free end side range is larger than impedance at arbitrary locations in the above-mentioned direction of plugging and unplugging within the proximal end side range. Therefore, since the frequency of the signal that generates resonance in the stub portions becomes higher, the impact of said resonance on the transmitted signal can be made extremely small. In addition, since this relationship of impedance magnitudes is satisfied regardless of the length of the above-mentioned stub portions, the quality of signal transmission is unlikely to be degraded even if the length of said stub portions, i.e., the effective mating length, is increased.

In the first invention, the above-mentioned contact arm portions of the above-mentioned first terminals may have a configuration that tapers from the proximal end side to the free end side.

As discussed before, the relationship of impedance magnitudes within the stub portions of the first terminals is affected by the opposed surface area and distance between said stub portions and metal members located around the periphery of said stub portions (for example, other terminals, ground plates, and the like). Specifically, the smaller the above-mentioned opposed surface area, the smaller the capacitance of the stub portions and, as a result, the larger the impedance. On the other hand, the larger the above-mentioned opposed surface area, the larger the capacitance of the stub portions and, as a result, the smaller the impedance. In addition, the longer the above-mentioned distance, the smaller the capacitance of the stub portions and, as a result, the larger the impedance. On the other hand, the shorter the above-mentioned distance, the larger the capacitance of the stub portions and, as a result, the smaller the impedance. In the first invention, as a result of using a tapered configuration for the contact arm portions of the first terminals, in the free end side range of the above-mentioned stub portions, the above-mentioned opposed surface area can be made smaller, the above-mentioned distance can be made longer, and impedance can be made larger than in the above-mentioned proximal end side range.

In the first invention, the above-mentioned contact arm portions of the above-mentioned first terminals may have a tapered configuration in which the width dimensions of said first terminals, i.e., their dimensions in the array direction, decrease in the above-mentioned direction of plugging and unplugging from the proximal end side to the free end side. In addition, in the first invention, the above-mentioned contact arm portions of the above-mentioned first terminals may have a configuration that tapers in the above-mentioned direction of plugging and unplugging from the proximal end side to the free end side when viewed in the terminal array direction.

In the first invention, some terminals among the multiple first terminals may be ground terminals.

Thus, if ground terminals are included among the multiple first terminals, then configuring the distance between the stub portions of the terminals (signal terminals) adjacent to said ground terminals and the stub portions of said ground terminals makes it possible to adjust the relationship of impedance magnitudes. For example, if the dimensions of the contact arm portion of each terminal have a tapered configuration decreasing in width towards the free end side, then the distance between the stub portions of adjacent terminals increases towards the free end side, and, for this reason, in the stub portions of the signal terminals, impedance at arbitrary locations of the free end side range in the above-mentioned direction of plugging and unplugging becomes larger than impedance at arbitrary locations of the above-mentioned proximal end side range in the above-mentioned direction of plugging and unplugging.

In the first invention, the first electrical connector may have ground plates disposed parallel to the contact arm portions of said first terminals within at least a portion of the array range of the multiple first terminals.

Thus, if the first electrical connector has ground plates, then configuring the opposed surface area between said ground plates and the stub portions of the terminals (signal terminals) adjacent to said ground plates makes it possible to adjust the relationship of impedance magnitudes. For example, if the dimensions of the contact arm portion of each terminal have a tapered configuration decreasing in width towards the free end side, then the opposed surface area between the stub portions of the signal terminals and the ground plates decreases towards the above-mentioned free end side and, for this reason, in the stub portions of the signal terminals impedance at arbitrary locations of the free end side range in the above-mentioned direction of plugging and unplugging becomes larger than impedance at arbitrary locations of the above-mentioned proximal end side range in the above-mentioned direction of plugging and unplugging.

In addition, for example, if the contact arm portion of each terminal has a configuration that tapers in the above-mentioned direction of plugging and unplugging towards the free end side when viewed in the direction of the terminal array, then the distance between the stub portions of the signal terminals and the ground plates increases towards the above-mentioned free end side and, for this reason, in the stub portions of the signal terminals impedance at arbitrary locations of the free end side range in the above-mentioned direction of plugging and unplugging becomes larger than impedance at arbitrary locations of the above-mentioned proximal end side range in the above-mentioned direction of plugging and unplugging.

<Second Invention>

The electrical connector according to the second invention is characterized in that it is used as a first electrical connector in the electrical connector assembly according to the first invention.

[Technical Effects]

In the present invention, as described above, when the stub portions of the first terminals provided in the first electrical connector are divided into a free end side range and a proximal end side range such that the center point in the above-mentioned direction of plugging and unplugging forms a boundary therebetween, in the arranged state of the above-mentioned first terminals impedance at arbitrary locations in the above-mentioned direction of plugging and unplugging within the free end side range is larger than impedance at arbitrary locations in the above-mentioned direction of plugging and unplugging within the proximal end side range and, for this reason, the frequency of the signal that generates resonance in the stub portions becomes higher and the impact of said resonance on the transmitted signal becomes extremely small. In addition, since this relationship of impedance magnitudes is satisfied regardless of the length of said stub portions, the quality of signal transmission is unlikely to be degraded even if the length of said stub portions, i.e., the effective mating length, is increased. Therefore, degradation in signal transmission quality can be adequately minimized while ensuring a sufficient effective mating length.

DETAILED DESCRIPTION

Some embodiments of the present invention will be described below with reference to the accompanying drawings. In particular, the present invention incorporates improvements on concepts from U.S. Pat. No. 10,249,989 with respect to an electrical connector assembly, the disclosure of which is hereby incorporated by reference in its entirety.

Figure 1:
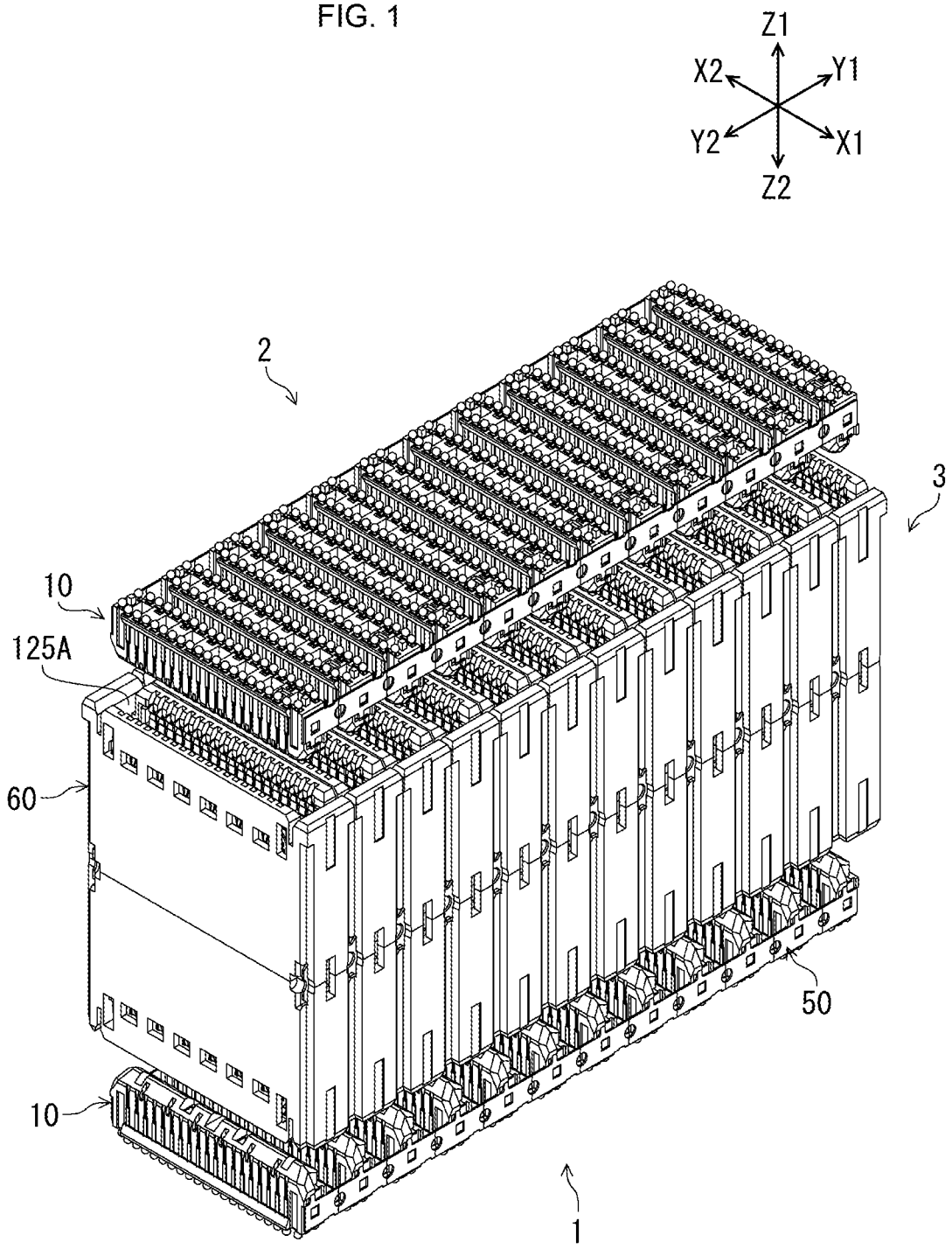
FIG. 1 illustrates an overall perspective view of an electrical connector assembly according to an embodiment of the present invention that illustrates a state prior to mating.
Figure 2:
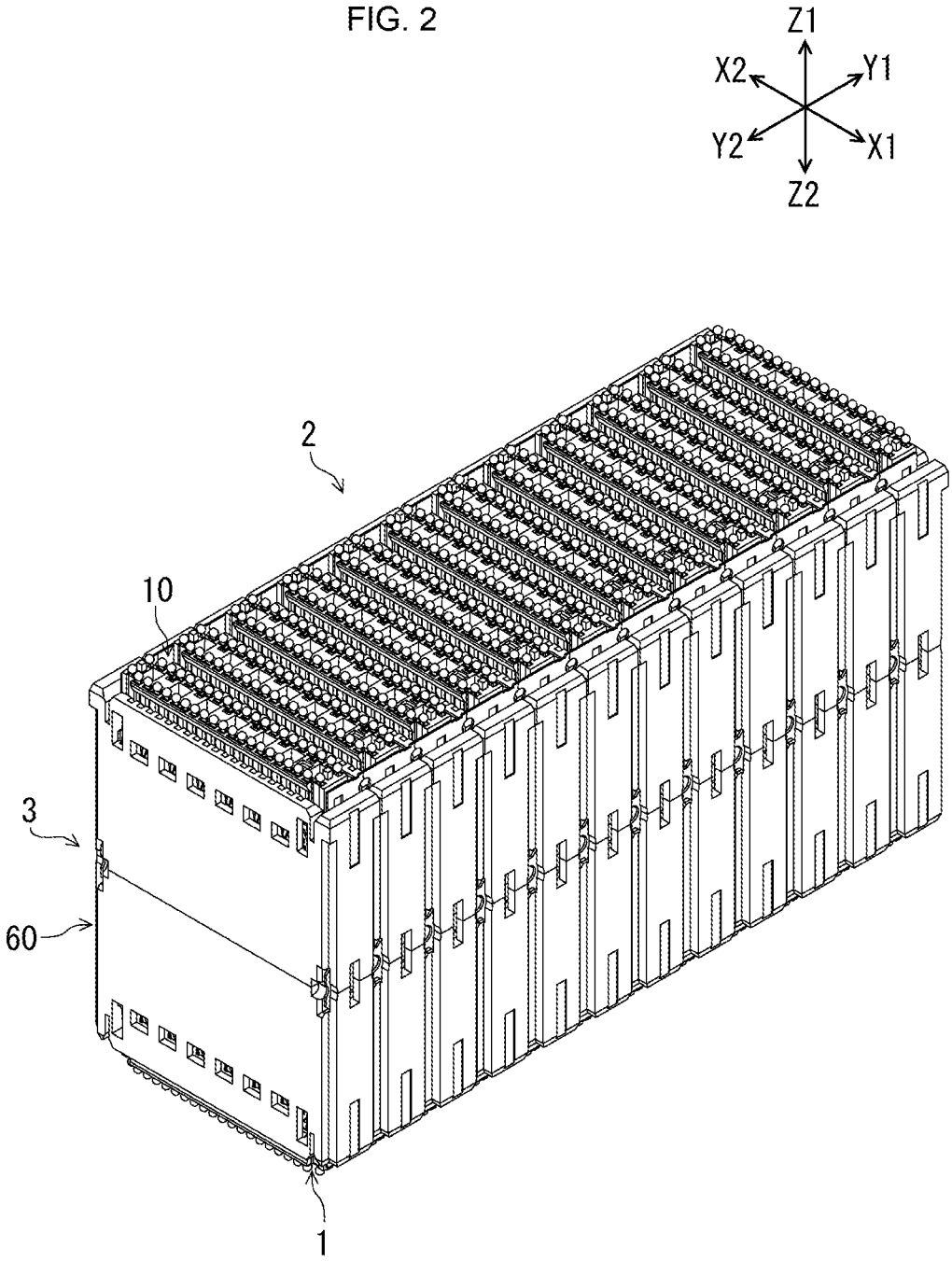
FIG. 2 illustrates an overall perspective view of the electrical connector assembly of FIG. 1 that illustrates a state after mating.

FIGS. 1 and 2 are perspective views illustrating an electrical connector assembly according to the present embodiment, wherein FIG. 1 shows the electrical connector assembly before mating and FIG. 2 shows it after mating. Said electrical connector assembly has electrical connectors for circuit boards 1, 2 (respectively referred to as "connector 1" and "connector 2" hereinbelow), which are used as two first electrical connectors, and an intermediate electrical connector 3, which is used as a second electrical connector (referred to as "intermediate connector 3" hereinbelow). Connectors 1 and 2, which are disposed on the mounting faces of respectively different circuit boards (not shown), are connected through the medium of the intermediate connector 3 disposed between the two connectors 1, 2 in a manner permitting plugging and unplugging such that the direction of diametrical opposition of the two circuit boards (Z-axis direction in FIGS. 1 and 2) is the direction of connector plugging and unplugging. In the present embodiment, connectors 1 and 2 have the same shape.

[Configuration of Connector 1]

As described hereafter, connector 1 is a plug connector having plug terminals 20, which are used as first terminals. As can be seen in FIG. 1 and FIG. 2, said connector 1 has a substantially rectangular parallelepiped-like external configuration that extends such that the Y-axis direction, which is parallel to the above-mentioned mounting faces, is its longitudinal direction. Said connector 1 has multiple (12 in the present embodiment) plug-side connect bodies 10 (see FIG. 3 (A)), which are arranged in an array direction coinciding with said longitudinal direction, and plug-side coupling members 50 made of sheet metal, which extend in the above-mentioned array direction (Y-axis direction) over the array range of the above-mentioned multiple plug-side connect bodies 10 and are used to connect and retain said multiple plug-side connect bodies 10 in place.

Figure 3A:
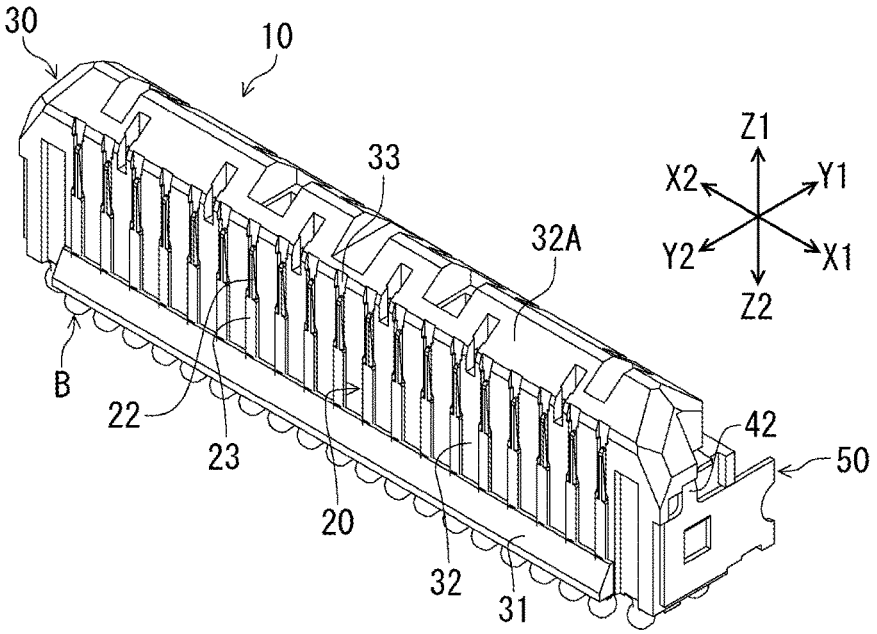
FIG. 3 (A) is a perspective view illustrating a connect body used in the electrical connector for circuit boards in isolation, and FIG. 3 (B) is a perspective view illustrating a connect body used in the intermediate electrical connector in isolation.
Figure 3B:
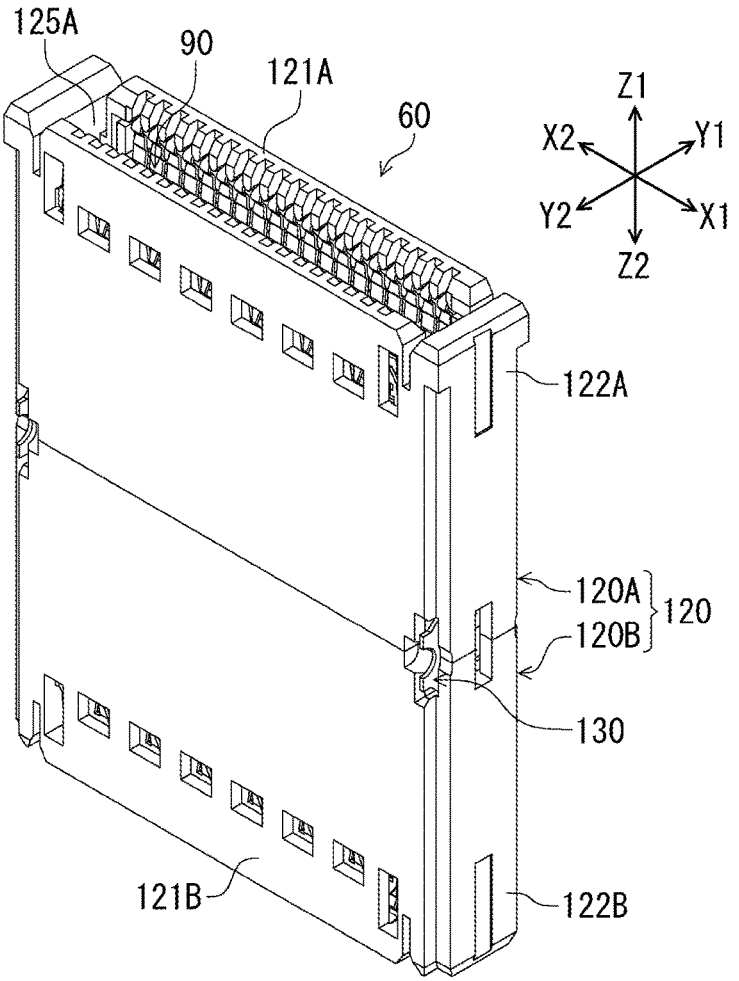

FIG. 3 (A) is an overall perspective view illustrating a single plug-side connect body 10. As can be seen in FIG. 3 (A), said plug-side connect body 10 has multiple plug terminals 20 made of sheet metal, which are arranged such that the connector width direction (X-axis direction), i.e. the transverse direction of connector 1, is the terminal array direction, a plug-side retainer 30 made of an electrically insulating material, in which said multiple plug terminals 20 are retained in place in array form using unitary co-molding, and two ground plates 40 made of sheet metal disposed extending over the terminal array range in the connector width direction (see FIGS. 6 (A) and 6 (B)).

Figure 4A:
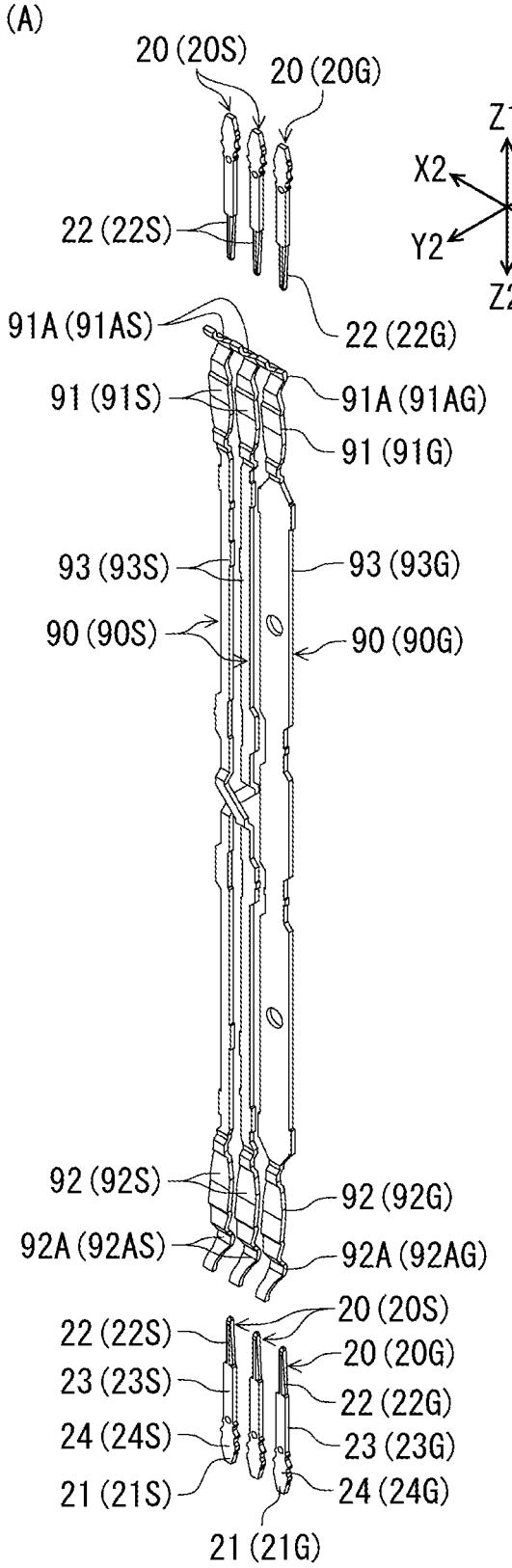
FIGS. 4 (A) and 4 (B) illustrate a perspective view illustrating some of the terminals provided in the electrical connector assembly, wherein FIG. 4 (A) shows an unconnected state and FIG. 4 (B) shows a connected state.
Figure 4B:
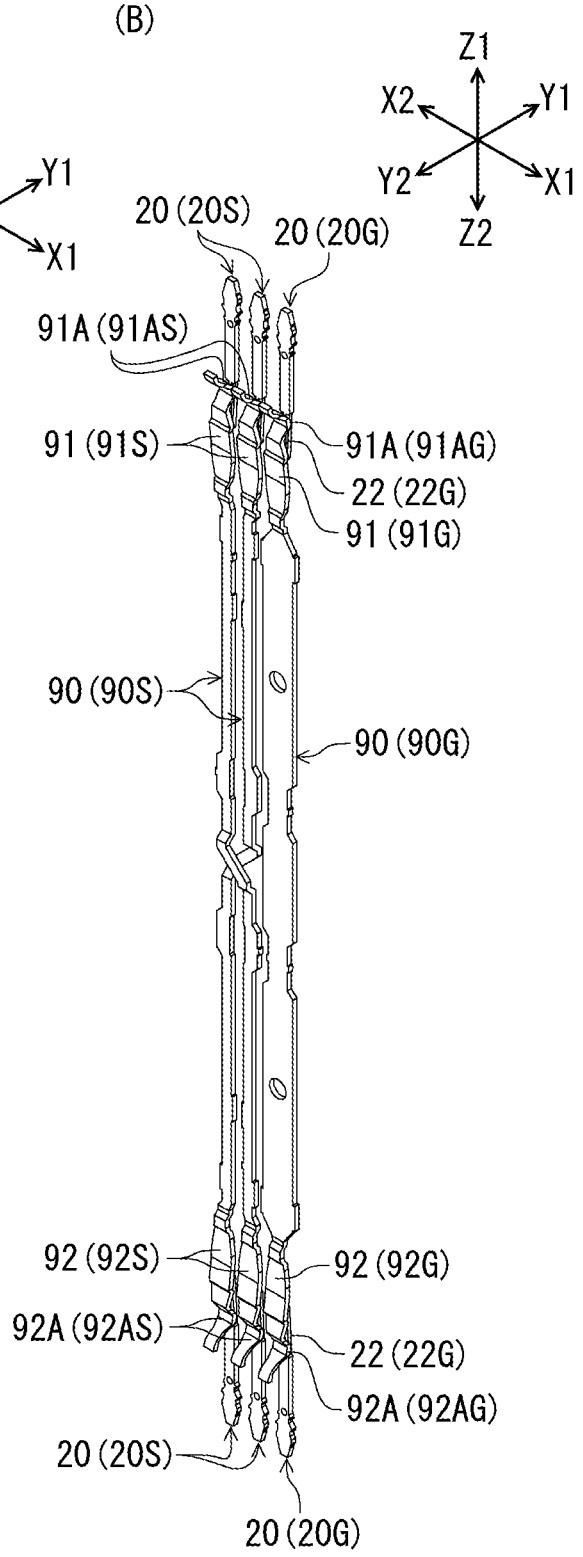

As can be seen in FIGS. 4 (A) and 4 (B), the plug terminals 20 are fabricated by punching a sheet metal member in the through-thickness direction, and their general shape is a strip-like shape rectilinearly extending in the up-down direction (Z-axis direction). The major faces of said plug terminals 20 are arranged in the connector width direction (X-axis direction) in an orientation perpendicular to the above-mentioned array direction (Y-axis direction). All the plug terminals 20 are of the same shape. In the present embodiment, the plug terminals 20 are used as signal terminals 20S or ground terminals 20G, with pairs of mutually adjacent signal terminals 20S arranged to be positioned on the opposite sides of a ground terminal 20G. FIGS. 4 (A) and 4 (B) illustrates only two signal terminals 20S and one ground terminal 20G. In the present embodiment, high-speed differential signals are adapted to be transmitted by pairs of mutually adjacent signal terminals 20S.

Below, the configuration is described using the phrase "plug terminals 20" when there is no need to make any particular distinction between the signal terminals 20S and ground terminals 20G. In addition, it is assumed that below, when the signal terminals 20S and the ground terminals 20G need to be distinguished in the description, the letter "S" is attached to the reference numeral of each component of the signal terminals 20S and the letter "G" is attached to the reference numeral of each component of the ground terminals 20G.

Figure 6B:
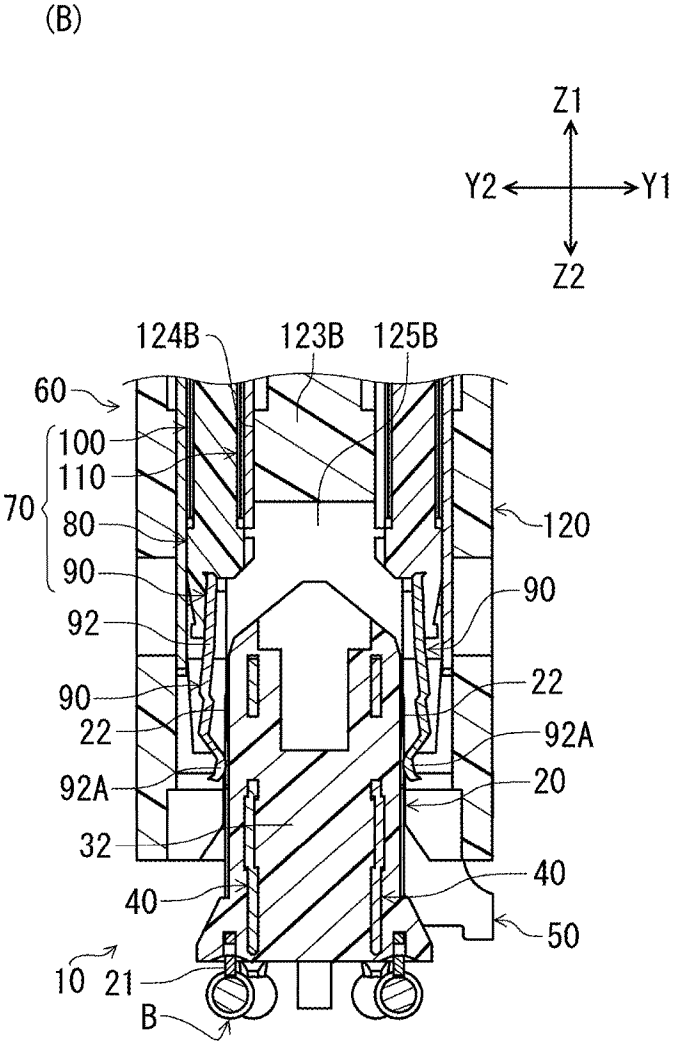
FIGS. 6 (A) and 6 (B) illustrate a cross-sectional view taken at the location of the receptacle terminals in the terminal array direction illustrating a portion of the electrical connector for circuit boards and the intermediate electrical connector, wherein FIG. 6 (A) shows an unconnected state, and FIG. 6 (B) shows a connected state.
Figure 6A:
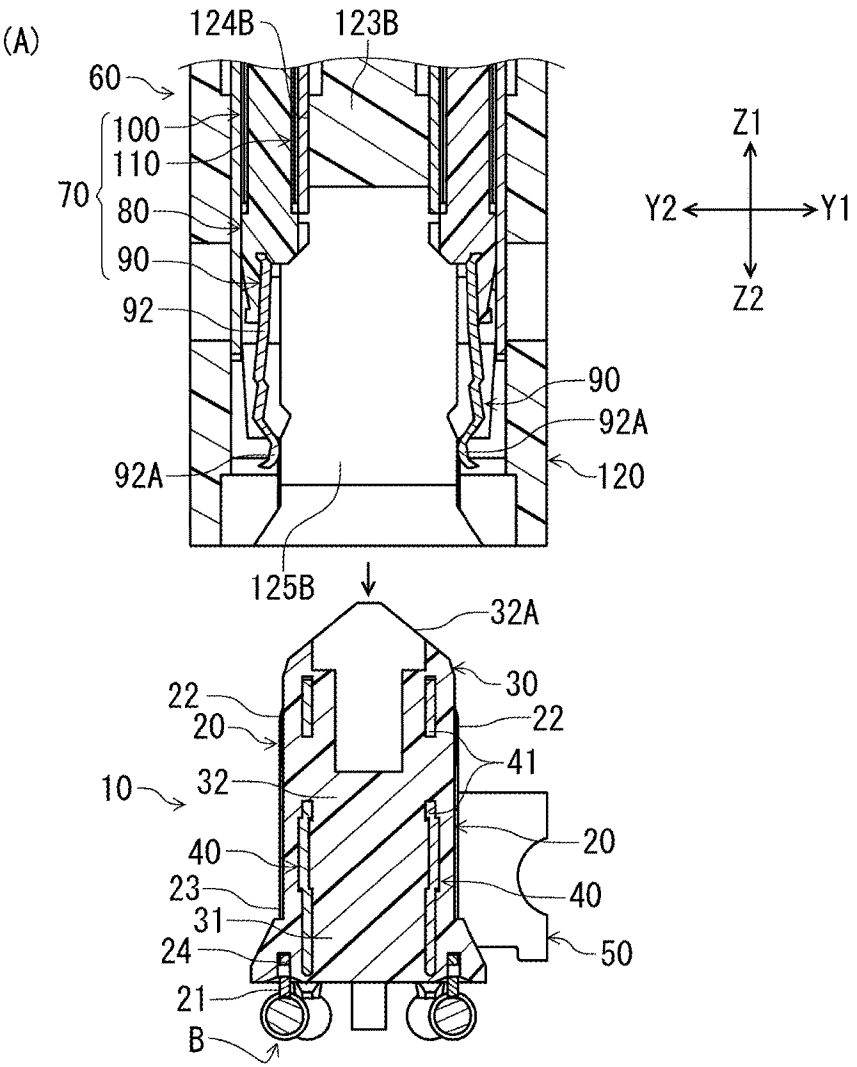

The plug terminals 20 are provided along both lateral faces (wall surfaces perpendicular to the above-mentioned array direction (Y-axis direction)) of the plug-side retainer 30 in two rows symmetrical about said plug-side retainer 30 in the Y-axis direction (see FIGS. 6 (A) and 6 (B)).

As can be seen in FIGS. 4 (A), 4 (B) and FIGS. 5 (A) and 5 (B), the plug terminals 20, on their lower end portions, have connecting portions 21 solder-connected to circuits (not shown) on the mounting face of a circuit board and, on the upper end side, have contact arm portions 22 used to contact the hereinafter-described receptacle terminals 90 provided in the intermediate connector 3. In addition, intermediate arm portions 23 extend downward from the lower ends of the contact arm portions 22 in a rectilinear manner and the lower ends of said intermediate arm portions 23 are coupled to the connecting portions 21 through the medium of the hereinafter-described retained portions 24. As can be seen in FIGS. 6 (A) and 6 (B), solder balls B used for solder connection to the above-mentioned circuits are attached to the connecting portions 21 (see also FIG. 3 (A)).

Figure 5A:
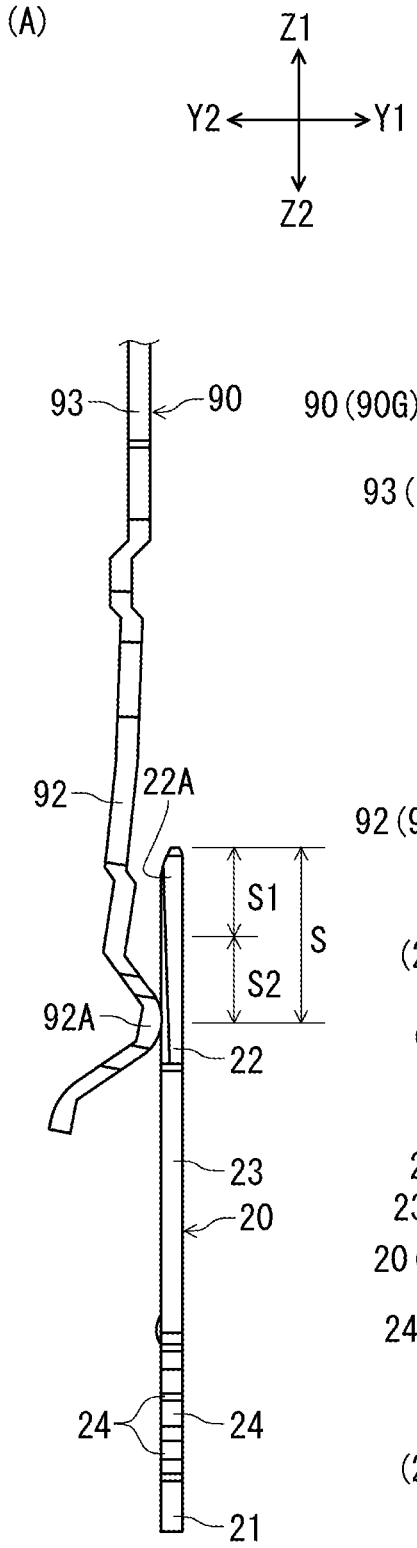
FIGS. 5 (A) and 5 (B) are views illustrating a section in which terminals are connected in the connected state, wherein FIG. 5 (A) is a view taken in the terminal array direction, and FIG. 5 (B) is a view taken in the array direction of the connect bodies.
Figure 5B:
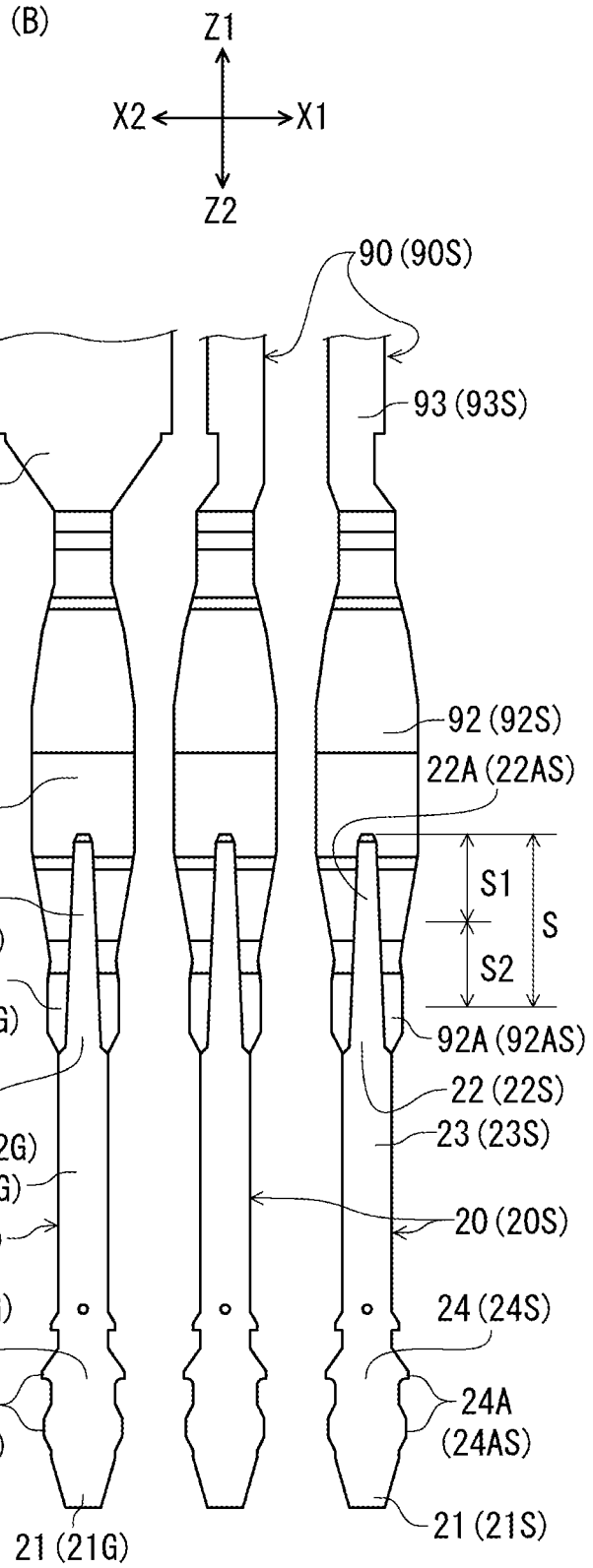

As can be seen in FIG. 5 (B), the contact arm portions 22 have a tapered configuration in which their width dimensions, that is, their dimensions in the array direction of the plug terminals 20, i.e., in the connector width direction (X-axis direction), decrease in the up-down direction (Z-axis direction) from the proximal end side (lower end side (Z2 side)) to the free end side (upper end side (Z1 side)). Since in the present embodiment the width dimensions of the contact arm portions decrease as one moves towards the free end side, the distance between the contact arm portions 22 of the plug terminals 20 mutually adjacent in the connector width direction (X-axis direction) increases as one moves from the proximal end side to the free end side. Therefore, the closer to the free end side, the smaller the capacitance of the contact arm portions 22 and, as a result, the larger the impedance.

As can be seen in FIGS. 5 (A) and 5 (B), in the state of contact with the convex contact point portions 92A of the hereinafter-described receptacle terminals 90, a portion of range S (referred to as "stub range S" below) of the above-mentioned contact arm portions 22, which extends in the up-down direction from the location of contact with said convex contact point portions 92A to the free ends (upper ends) of said contact arm portions 22, constitutes a stub portion 22A. The length of the stub portion 22 will be longer or shorter depending on the location of contact with the convex contact point portion 92A in the up-down direction within the contact arm portion 22. Namely, the closer said location of contact is to the proximal end of the contact arm portion 22 (lower end in FIGS. 5 (A) and 5 (B)), the larger the stub range S becomes and, therefore, the longer the stub portion 22A will be. The closer said location of contact is to the upper end of the contact arm portion 22 (upper end in FIGS. 5 (A) and 5 (B)), the smaller the stub range S becomes and, therefore, the shorter the stub portion 22A will be.

In the present embodiment, as a result of using a tapered configuration for the contact arm portions 22, when the above-mentioned stub portions 22A are divided into a free end side range S1 and a proximal end side range S2 such that the center point in the up-down direction forms a boundary therebetween, in the arranged state of the above-mentioned plug terminals 20, impedance at arbitrary locations in the up-down direction within the free end side range S1 is larger than impedance at arbitrary locations in the up-down direction within the proximal end side range S2.

As can be seen in FIG. 5 (B), the intermediate arm portions 23 are formed to be of the same width dimensions throughout their entire vertical extent and said width dimensions are larger than the maximum width dimensions of the contact arm portions 22. The retained portions 24 have press-fit projections 24A at two locations of both vertically extending lateral edge portions in the up-down direction, with said projections press-fitted into the hereinafter-described terminal holding portions 33 of the plug-side retainer 30.

As can be seen in FIG. 3 (A), the plug-side retainer 30 extends such that the connector width direction (X-axis direction) is its longitudinal direction. The plug-side retainer 30 has a base portion 31 that constitutes the bottom portion of said plug-side retainer 30, and a mating wall portion 32 that upstands upward from said base portion 31 (see also FIGS. 6 (A) and 6 (B)). Said mating wall portion 32 is formed as a mating portion that fits into the hereinafter-described receiving portion 125B of the intermediate connector 3 (see also FIG. 6 (B)). As can be seen in FIG. 3 (A), the top portion of said mating wall portion 32 has a tapered configuration when viewed in the connector width direction, with both lateral faces thereof forming inclined surfaces tilted so as to approach each other as one moves upwards (see also FIGS. 6 (A) and 6 (B)). The above-mentioned inclined surfaces are formed as guiding surfaces 32A that guide the receptacle-side connect bodies 60 to the standard mating position in the process of connector mating.

In addition, multiple terminal holding portions 33 extending in the up-down direction along both lateral faces of said plug-side retainer 30 (wall surfaces perpendicular to the Y-axis direction) are formed in array form in the plug-side retainer 30 at regular intervals in the connector width direction, with said terminal holding portions 33 adapted to hold and retain the plug terminals 20 in place. Said terminal holding portions 33, which are formed within the bounds of the mating wall portion 32 in the up-down direction as groove portions on both lateral faces of said mating wall portion 32 extending in the connector width direction (see FIG. 3 (A)), are formed as apertures that are in communication with the above-mentioned groove portions and pass through said base portion 31 within the bounds of the base portion 31 in the up-down direction (see FIGS. 6 (A) and 6 (B)).

In the present embodiment, the plug terminals 20 are inserted into the terminal holding portions 33 from below and are retained by press-fitting within said terminal holding portions 33 due to the fact that the press-fit projections 24A of said plug terminals 20 bite into the interior wall surface of the terminal holding portions 33. As can be seen in FIG. 3 (A) and FIGS. 6 (A) and 6 (B), when said plug terminals 20 are retained in place by press-fitting, one major face and a portion of both lateral end faces (through-thickness faces extending in the up-down direction) of the contact arm portions 22 and intermediate arm portions 23 of the plug terminals 20 are exposed in the terminal holding portions 33.

In addition, aperture portions (not shown), which open inward in the Y-axis direction, are formed on the bottom (interior wall surface perpendicular to the Y-axis direction) of the terminal holding portions 33 in which the hereinafter-described ground terminals 20G are contained, and the contact arm portions 22G of the hereinafter-described ground terminals 20G are exposed in the above-mentioned aperture portions. As a result, the ground plates 40 (see FIGS. 6 (A and 6 (B)) are adapted to be able to contact the contact arm portions 22G of the ground terminals 20G.

The ground plates 40 are fabricated by press-forming and bending a sheet metal member. The ground plates 40 have major faces perpendicular to the array direction of the plug-side connect bodies 10 (Y-axis direction) and, in the connector width direction (X-axis direction), have grounding body portions 41 extending over a range that comprises the entire array range of the plug terminals 20 (see FIG. 6 (A)). In addition, the ground plates 40 also have coupling piece portions 42, which are described below. The grounding body portions 41 are coupled to the plug-side coupling members 50 by said coupling piece portions 42.

As can be seen in FIG. 6 (A), the grounding body portions 41 of two ground plates 40 extend in the connector width direction (X-axis direction perpendicular to the plane of the drawing in FIG. 6 (A)) inside the plug-side retainer 30, i.e., between the terminal rows of the plug terminals 20 arranged in two rows.

In addition, on both ends of the grounding body portions 41, the ground plates 40 have coupling piece portions 42 that couple said grounding body portions 41 to the plug-side coupling members 50. Said coupling piece portions 42 extend from both ends of the grounding body portions 41 in a curved manner in the through-thickness direction and, as can be seen in FIG. 3 (A), couple the ends of the grounding body portions 41 and the top edges of the plug-side coupling members 50.

As can be seen in FIG. 1 to FIG. 3 (A), the major faces of the plug-side coupling members 50, which are oriented perpendicularly to the connector width direction (X-axis direction) and disposed at both ends of the plug-side connect bodies 10 in the connector width direction, extend in the array direction of said plug-side connect bodies 10 (Y-axis direction) over the entire extent of the array range of said plug-side connect bodies 10. As discussed before, said plug-side coupling members 50 are coupled to the grounding body portions 41 provided in each plug-side connect body 10 via the coupling piece portions 42 of the ground plates 40, thereby connecting and retaining all the plug-side connect bodies 10 in place.

In the present embodiment, an improved grounding effect can be achieved because each pair of ground plates 40 is electrically connected by the plug-side coupling members 50. Further, since the end faces (faces perpendicular to the X-axis direction) of the plug-side connect bodies 10 are covered by the major faces of the plug-side coupling members 50, the latter can also be used as shielding plates.

In addition, although in the present embodiment the ground plates 40 and the plug-side coupling members 50 are fabricated from identical sheet metal members in an integral manner, it is not essential to fabricate identical members in this manner and said ground plates 40 and said plug-side coupling members 50 may be adapted to be formed separately as different members.

[Assembly of Connector 1]

The thus-configured connector 1 is fabricated in the following manner. First, with the matched major faces of the grounding body portions 41 of two ground plates 40 facing each other in the array direction of said plug-side connect bodies 10 (Y-axis direction), these grounding body portions 41 are retained in place in the plug-side retainer 30 using unitary co-molding. During this unitary co-molding, the coupling piece portions 42 of the ground plates 40, to which the plug-side retainer 30 is coupled, are not yet bent and the major faces of said plug-side coupling members 50 are at right angles to the up-down direction (Z-axis direction).

Next, the plug-side coupling members 50 are placed in proximity to the end faces of the plug-side retainer 30 in a face-to-face relationship therewith by bending both ends of the ground plates 40 in the connector width direction (see FIG. 1 to FIG. 3 (A)). The plug terminals 20 are then press-fitted into the terminal holding portions 33 of the plug-side retainer 30 from below, causing the press-fit projections 24A of said plug terminals 20 to bite into the interior wall surface of the terminal holding portions 33, thereby retaining said plug terminals 20 in place in the plug-side retainer 30 and completing the assembly of connector 1.

[Configuration of Connector 2]

Since connector 2 has exactly the same configuration as connector 1, its components are assigned the same reference numerals as the respective components of connector 1 and are not further discussed herein.

[Configuration of Intermediate Connector 3]

As described below, the intermediate connector 3 is a receptacle connector provided with receptacle terminals 90 serving as second terminals. Said intermediate connector 3 has a substantially rectangular parallelepiped-like external configuration extending such that the Y-axis direction, which is parallel to the above-mentioned mounting face, is its longitudinal direction. Said intermediate connector 3 has multiple (12 in the present embodiment) receptacle-side connect bodies 60, which are arranged in an array direction coinciding with said longitudinal direction (see FIG. 3 (B)) and receptacle-side coupling members 130 made of sheet metal, which extend in the above-mentioned array direction (Y-axis direction) over the array range of the above-mentioned multiple receptacle-side connect bodies 60, and which connect and retain said multiple receptacle-side connect bodies 60 in place (see FIG. 3 (B)).

As can be seen in FIG. 3 (B) and FIGS. 6 (A) and 6 (B), the receptacle-side connect bodies 60 have two interconnect blades 70 (see FIGS. 6 (A) and 6 (B)), which are described below, and a receptacle-side retainer 120 made of an electrically insulating material, which holds and retains said two interconnect blades 70 in place such that their major faces are parallel.

As shown by their portion (bottom portion) illustrated in FIGS. 6 (A) and 6 (B), the interconnect blades 70 have a plate-shaped insulating plate 80 made of an electrically insulating material, multiple receptacle terminals 90 retained in place in array form on said insulating plate 80 using unitary co-molding, as well as an external ground plate 100 and an internal ground plate 110, which are provided facing both major faces of the insulating plate 80. Said interconnect blades 70 have a vertically symmetric configuration.

The multiple receptacle terminals 90, which are fabricated by punching a sheet metal member in the through-thickness direction, has a generally strip-like configuration extending rectilinearly in the up-down direction (Z-axis direction). The major faces of said receptacle terminals 90 are arranged in the connector width direction (X-axis direction) in an orientation perpendicular to the array direction (Y-axis direction) of the receptacle-side connect bodies 60. As can be seen in FIG. 4 (A), 4 (B), and FIG. 5 (B), the terminal width dimensions (dimensions in the X-axis direction) of the receptacle terminals 90 are larger than the terminal width dimensions of the plug terminals.

The multiple receptacle terminals 90 are used as signal terminals 90S or as ground terminals 90G. The receptacle terminals 90, which are located in alignment with the plug terminals 20 of connectors 1, 2, have pairs of mutually adjacent signal terminals 90S arranged to be positioned on opposite sides of a ground terminal 90G. FIGS. 4 (A) and 4 (B) illustrates only two signal terminals 20S and one ground terminal 20G.

In the present embodiment, two adjacent signal terminals 90S located on one side (side X2 in FIGS. 4 (A) and 4 (B)) of a ground terminal 90G in the array direction of the receptacle terminals 90 (X-axis direction) form a cross-pair intersecting at an intermediate location in the up-down direction. In addition, two adjacent signal terminals (not shown) located on the other side (side X1 in FIGS. 4 (A) and 4 (B)) of the ground terminal 90G form a straight pair extending in a rectilinear manner in different mutually intersecting up-down directions. In the present embodiment, the signal terminals 90S are adapted to transmit high-speed differential signals by forming a straight pair and a cross-pair from the above-mentioned two signal terminals 90S in this manner.

Below, the configuration is described by referring to the signal terminals 90S and the ground terminals 90G as "receptacle terminals 90" for brevity if there is no need to make any particular distinction between the two. In addition, it is assumed that below, when the signal terminals 90S and the ground terminals 90G need to be distinguished in the description, the letter "S" is attached to the reference numeral of each component of the signal terminals 90S and the letter "G" is attached to the reference numeral of each component of the ground terminals 90G.

As can be seen in FIGS. 4 (A) and 4 (B), the pair of signal terminals 90S that form the cross-pair have resilient arm portions 91S and resilient arm portions 92S resiliently displaceable in the through-thickness direction (Y-axis direction in FIGS. 4 (A) and 4 (B)), formed respectively on the upper end side and on the lower end side of said signal terminals 90S, with said resilient arm portions 91S and resilient arm portions 92S coupled by intermediate line portions 93S that extend in the up-down direction.

The resilient arm portions 91S located on the upper end side (Z1 side) of the signal terminals 90S have convex contact point portions 91AS, which are obtained by bending in the upper end portions (free end portions) in the through-thickness direction and which protrude to one side (side Y1 in FIGS. 4 (A) and 4 (B)) in the Y-axis direction. In addition, the resilient arm portions 92S have convex contact point portions 92AS, which are obtained by bending in the lower end portions (free end portions) in the through-thickness direction and which protrude to the above-mentioned one side (side Y1 in FIGS. 4 (A) and 4 (B)) in the Y-axis direction. In addition, as can be seen in FIGS. 4 (A) and 4 (B), the intermediate line portions 93S of the pair of signal terminals 90S that form the cross-pair intersect without coming into contact with each other in a central area in the up-down direction due to the fact that one intermediate line portion 93S and the other intermediate line portion 93S are bent in a direction that keeps them spaced apart in the through-thickness direction.

The pair of signal terminals that form the straight pair (not shown in FIGS. 4 (A) and 4 (B)) are shaped by replacing the intermediate line portions 93S of the signal terminals 90S that form the cross-pair with intermediate line portions extending in the up-down direction in a rectilinear configuration without intersecting each other.

As can be seen in FIGS. 4 (A) and 4 (B), the ground terminal 90G has resilient arm portions 91G, 92G of the same shape as the resilient arm portions 91S, 92S of the signal terminals 90S constituting the cross-pair. At the same time, an intermediate line portion 93G, which extends in a rectilinear configuration in the up-down direction, couples the two resilient arm portions 91G, 92G. Said intermediate line portion 93G is formed such that that the terminal width is larger than the intermediate line portions 93S of the signal terminals 90S.

The resilient arm portions 91 of the receptacle terminals 90 are located in the hereinafter-described receiving portion 125A of the upper retainer 120A and, in addition, the resilient arm portions 92 are located in the hereinafter-described receiving portion 125B of the lower retainer 120B in a manner permitting resilient displacement in the Y-axis direction. In addition, the convex contact point portions 91A, 92A of the resilient arm portions 91, 92 are located protruding toward the receiving portions 125A, 125B.

As can be seen in FIGS. 6 (A) and 6 (B), the external ground plate 100 is located on the outside of the receptacle terminal 90 in the Y-axis direction, i.e., on the side opposite to the hereinafter described receiving portion 125B in the Y-axis direction, and, on the other hand, the internal ground plate 110 is located inwardly of the receptacle terminal 90, i.e., on the side of the receiving portion 125B in the Y-axis direction.

In the up-down direction, the external ground plate 100 extends over a range extending from an intermediate location of the upper resilient arm portion 91G of the receptacle terminal 90 to an intermediate location of the lower resilient arm portion 92G (see also FIGS. 6 (A) and 6 (B)). In the up-down direction, the internal ground plate 110 extends over substantially the entire extent of the intermediate line portion 93G of the receptacle terminal 90 (see also FIGS. 6 (A) and 6 (B)). In addition, the external ground plate 100 and internal ground plate 110, which have sections (not shown) that are curved and protruding towards the ground terminal 90G at locations corresponding to said ground terminal 90G in the array direction of the receptacle terminals 90 (X-axis direction), can use these protruding sections to contact and establish an electrical connection to the major faces of the ground terminal 90G. The external ground plate 100 and internal ground plate 110 are attached to the insulating plate 80 by ultrasonic welding or the like.

The interconnect blades 70 are fabricated in accordance with the following procedure. First, the receptacle terminals 90, including one ground terminal 90G, two signal terminals 90S that form a cross-pair, one ground terminal 90G, and two signal terminals 90S that form a straight pair are placed in a mold (not shown) and successively repeated in the above-described order. Next, after injecting resin into the space formed in the mold and performing unitary co-molding of the receptacle terminals 90 and the insulating plate 80, semi-finished interconnect blades 70 are obtained. Further, the fabrication of the interconnect blades 70 is completed by attaching the external ground plate 100 and internal ground plate 110 to the respectively corresponding major faces of said semifinished product on both major faces of said semifinished product.

As can be seen in FIG. 3 (B), the receptacle-side retainer 120 is split at the center point in the up-down direction and has an upper retainer 120A that forms a top half and a lower retainer 120B that forms a bottom half. As can be seen in FIG. 3 (B), the shape of the upper retainer 120A and the lower retainer 120B is substantially symmetrical in the up-down direction.

As can be seen in FIG. 3 (B), the upper retainer 120A, which is shaped as a substantially square cylinder extending in the up-down direction, has two lateral walls 121A extending in the connector width direction (X-axis direction), end walls 122A that extend in the array direction (Y-axis direction) of the receptacle-side connect bodies 60 and couple the ends of said two lateral walls 121A, and a center wall (not shown), which extends between the two lateral walls 121A in the connector width direction and couples the interior wall surfaces of the two end walls 122A. The upper end face of said center wall is located below the upper end faces of the lateral walls 121A and end walls 122A. At the upper end side of the upper retainer 120A, an upwardly open space enclosed by the interior wall surfaces of the two lateral walls 121A, the interior wall surfaces of the two end walls 122A, and the upper end face of the center wall forms a receiving portion 125A that receives the mating portions of the plug-side connect bodies 10 of connector 2 from above. In addition, the spaces passing through in the up-down direction between the respective lateral walls 121A and the above-mentioned center wall form upper holding portions (not shown) accommodating the top halves of the interconnect blades 70.

The shape of the lower retainer 120B is obtained by turning the upper retainer 120A upside down. The respective components of the lower retainer 120B are assigned reference numerals obtained by substituting the letter "B" for the letter "A" in the reference numerals of the corresponding sections in the upper retainer 120A, and their shape is not further discussed herein. In addition, while the center wall and the upper holding portions of the upper retainer 120A are not shown in any of the drawings, FIGS. 6 (A) and 6 (B) shows that the center wall of the lower retainer 120B is assigned the reference numeral "123B" and, in addition, the lower holding portions of the lower retainer 120B are assigned the reference numeral "124B."

The receptacle-side connect bodies 60 are assembled such that the top halves of the two interconnect blades 70 are held and retained in place in the upper holding portions of the upper retainer 120A and, at the same time, the bottom halves of said two interconnect blades 70 are held and retained in place in the lower holding portions 124B of the lower retainer 120B. Specifically, the top halves of the two interconnect blades 70 are inserted into the two upper holding portions of the upper retainer 120A from below and, at the same time, the bottom halves of said two interconnect blades 70 are inserted into the two lower holding portions of the lower retainer 120B from above. At such time, the two interconnect blades 70 are retained in place in the upper holding portions and lower holding portions 124B while being oriented such that the internal ground plates 110 are in a face-to-face relationship with the two interconnect blades 70. In addition, it is preferable to provide engaging portions in the upper retainer 120A and the lower retainer 120B and, at the same time, provide portions engageable with said engaging portions in the up-down direction in the interconnect blades 70, such that the extraction of the interconnect blades 70 is prevented by means of vertical engagement of the engaging portions with the engaged portions.

The receptacle-side coupling members 130 are formed as sheet metal members extending in the Y-axis direction over the entire extent of the array range of the receptacle-side connect bodies 60. As can be seen in FIG. 3 (B), said receptacle-side coupling members 130 are provided in the central area of the receptacle-side connect bodies 60 in the up-down direction at both ends of said receptacle connect bodies 60 in the connector width direction (X-axis direction), and the major faces of said receptacle-side coupling members 130 are disposed at right angles to the connector width direction.

As can be seen in FIG. 3 (B), said receptacle-side coupling members 130 are located so as to be sandwiched in the up-down direction between the ends of the lower retainer and the ends of the upper retainer 120A in the connector width direction; for example, the receptacle-side retainers 120 are retained in place via vertical engagement of the engaging portions formed in the receptacle-side coupling members 130 with the engaged portions formed at both ends of the two retainers 120A, 120B.

[Assembly of Intermediate Connector 3]

The intermediate connector 3 is assembled by connecting and retaining the multiple receptacle-side connect bodies 60 in place using the receptacle-side coupling members 130. Specifically, during assembly of each receptacle-side connect body 60, simultaneously with assembling the upper retainer 120A to the two interconnect blades 70 from above and the lower retainer 120B from below, the upper retainer 120A and the lower retainer 120B are attached to the receptacle-side coupling members 130 in accordance with the above-described procedure, thereby completing assembly.

[Connector Mating Operation]

First, connectors 1, 2 are mounted to the corresponding circuits of the respectively corresponding circuit boards. Specifically, the connecting portions 21 of the plug terminals 20 provided in connectors 1, 2 are solder-connected to the corresponding circuits of the circuit boards.

Next, as shown in FIG. 1 and FIG. 6 (A), the mating wall portions 32 (mating portions) of connector 1 are oriented so as to extend upward from the base portion 31 and, at the same time, the lower receiving portion 125B formed in each receptacle-side connect body 60 of the intermediate connector 3 is arranged in a downwardly open orientation and said intermediate connector 3 is positioned above connector 1. The receiving portions 125B of the receptacle-side connect body 60 are then positioned in alignment with the mating wall portions 32 of the respectively corresponding plug-side connect bodies 10.

Next, the intermediate connector 3 is lowered and each receptacle-side connect body 60 is mated with the respectively corresponding plug-side connect body 10 from above. At such time, the mating wall portions 32 of the plug-side connect bodies 10 cause the resilient arm portions 92 of the receptacle terminals 90 opposed in the above-mentioned array direction to be resiliently displaced apart from each other, in other words, to expand the distance between said resilient arm portions 92, and enter the receiving portions 125B from below.

As can be seen in FIG. 6 (B), when the plug-side connect bodies 10 and receptacle-side connect bodies 60 are mated, the contact arm portions 22 of the plug terminals 20 and the resiliently displaced convex contact point portions 92A of the receptacle terminals 90 are pushed into mutual contact under contact pressure and placed in electrical communication. Specifically, the contact arm portions 22S of the signal terminals 20S are brought into contact with the convex contact point portions 92AS of the signal terminals 90S (see FIG. 4 (B) and FIG. 6 (B)) and the contact arm portions 22G of the ground terminals 20G are brought into contact with the convex contact point portions 92AG of the ground terminals 90G (see FIG. 4 (B)). In this manner, all the plug-side connect bodies 10 and receptacle-side connect bodies 60 are mated, thereby completing the operation of mating connector 1 with intermediate connector 3.

Next, as can be seen in FIG. 1, connector 2 is positioned above the intermediate connector 3 while being in a vertically inverted orientation with respect to connector 1, and connector 2 is matingly connected to the intermediate connector 3 in accordance with the same procedure as in the operation of mating connector 1 with intermediate connector 3. As a result, as can be seen in FIG. 2, connector 1 is matingly connected to the intermediate connector 3 from below and connector 2 from above, thereby establishing electrical communication between connectors 1 and 2 via the intermediate connector 3.

As can be seen in FIGS. 5 (A) and 5 (B), in the mated state of connector 1 and intermediate connector 3, the resilient arm portions 92 of the receptacle terminals 90 are in a resiliently displaced state and the convex contact point portions 92A of said resilient arm portions 92 are brought into contact with said contact arm portions 22 under contact pressure at intermediate locations of the contact arm portions 22 of the plug terminals 20 in the up-down direction. At such time, a stub range S is formed in the contact arm portions 22 within a range extending from the location of contact between the contact arm portions 22 and the convex contact point portions 92A in the up-down direction to the free ends (upper ends) of said contact arm portions 22, and the section extending in the up-down direction within said stub range S constitutes a stub portion 22A.

In the present embodiment, as discussed before, the contact arm portions 22 of the plug terminals 20 have a tapered configuration, in which the terminal width dimensions (dimensions in the X-axis direction) decrease as one moves towards the free ends. As a result of using such a tapered configuration for the contact arm portions 22, in the stub portion 22A of a single signal terminal 20S, as one moves towards the free end side of said stub portion 22A, the distance between adjacent signal terminals 20S and to the ground terminals 20G increases, and, in addition, the surface area opposed to the adjacent ground plates 40 becomes smaller. Therefore, as one moves toward the free end side of the stub portions 22A, the capacitance of said stub portion 22A increases and, as a result, its impedance becomes smaller.

Further, in the present embodiment, when the stub portion 22A is divided into a free end side range S1 and a proximal end side range S2 such that the center point in the up-down direction forms a boundary therebetween, in the arranged state of the above-mentioned plug terminals 20, impedance at arbitrary locations in the up-down direction within the free end side range S1 is larger than impedance at arbitrary locations in the up-down direction within the proximal end side range S2.

Therefore, the frequency of the signal that generates resonance in the stub portions 22A becomes higher and, as a result, the impact of said resonance on the transmitted signals becomes extremely small. In addition, since this relationship of impedance magnitudes is satisfied regardless of the length of the above-mentioned stub portions 22A, the quality of signal transmission is unlikely to be degraded even if the length of said stub portions 22A, i.e., the effective mating length, is increased. Thus, in accordance with the present embodiment, degradation in signal transmission quality can be adequately minimized while ensuring a sufficient effective mating length.

Although FIGS. 5 (A) and 5 (B) was referenced above while discussing the minimization of degradation in the quality of signal transmission between the plug terminals 20 of connector 1 and the receptacle terminals 90 of the intermediate connector 3, as mentioned before, connector 2 has the same configuration as connector 1, so it goes without saying that degradation in the quality of signal transmission between the plug terminals 20 of connector 2 and the receptacle terminals 90 of the intermediate connector 3 is minimized while ensuring a sufficient effective mating length.

Although in the present embodiment the contact arm portions 22 of the plug terminals 20 have a tapered configuration in which the terminal width dimensions (dimensions in the X-axis direction) decrease as one moves toward the free end side, the contact arm portions 22 may alternatively or additionally be adapted to have a tapered configuration in which their through-thickness dimensions decrease as one moves toward the free end side when viewed in the terminal array direction (Y-axis direction). If the contact arm portions 22 are thus given a tapered configuration when viewed in the terminal array direction, in the stub portion 22A of a single signal terminal 20S, as one moves toward the free end side of said stub portion 22A, the surface area opposed to the adjacent signal terminals 20S and ground terminals 20G becomes smaller and, in addition, the distance to the adjacent ground plates 40 increases. Therefore, as one moves toward the free end side of the stub portions 22A, the capacitance of said stub portion 22A increases and, as a result, its impedance becomes smaller.

Although in the present embodiment some terminals among the plug terminals 20 and some terminals among the receptacle terminals 90G are used as ground terminals, it is not essential to use ground terminals, and all the terminals may be used as signal terminals. In addition, although in the present embodiment the ground plates 40, external ground plates 100, and internal ground plates 110 are provided over the entire extent of the terminal array range, as an alternative, they may be provided within a portion of the terminal array range.

Although the present embodiment discusses a connector assembly in which two connectors 1, 2 serving as plug connectors are connected through the medium of an intermediate connector 3 serving as a receptacle connector, the forms of connector assemblies to which the present invention can be applied are not limited thereto. For example, the present invention may be applied to a connector assembly having one plug connector used as a connector for circuit boards and one receptacle connector used as another connector for circuit boards.

Although the present embodiment discusses an example in which the present invention is applied to an electrical connector assembly wherein both connectors are plugged and unplugged in a direction perpendicular to the mounting faces of both circuit boards, the present invention is also applicable to an electrical connector assembly wherein the direction of connector plugging and unplugging is, for example, perpendicular to the mounting face of one circuit board and, at the same time, parallel to the mounting face of the other circuit board, i.e., to an electrical connector assembly having so-called right-angle electrical connectors. In addition, the present invention is also applicable to an electrical connector assembly in which the direction of connector plugging and unplugging is a direction parallel to the mounting faces of both circuit boards.

DESCRIPTION OF THE REFERENCE NUMERALS

1, 2 Connectors (first electrical connectors)
3 Intermediate connector (second electrical connector)
20 Plug terminal (first terminal)
20G Ground terminal
22 Contact arm portion
22A Stub portion
40 Ground plate
90 Receptacle terminal (second terminal)
91A, 92A Convex contact point portions
S1 Free end side range
S2 Proximal end side range

What is claimed is:

1. An electrical connector assembly comprising:

a first electrical connector and a second electrical connector connected in a manner permitting plugging into and unplugging from each other, the first electrical connector comprises a plurality of first terminals arranged such that the array direction is a direction perpendicular to the direction of plugging and unplugging into or from the second electrical connector;

wherein said first terminals, in their free end portions located on the connector mating side, comprise contact arm portions extending in a rectilinear manner in the direction of plugging and unplugging;

the second electrical connector comprises a plurality of second terminals arranged in a same direction as the array direction of the first terminals;

wherein said second terminals, in their free end portions located on the connector mating side, have convex contact point portions contactable with the intermediate portions of the contact arm portions of the first terminals in the direction of plugging and unplugging; and, when stub portions in the contact arm portions of the first terminals, which extend in the direction of plugging and unplugging from the locations of contact with the convex contact point portions of the second terminals to the free ends of said contact arm portions, are divided into a free end side range and a proximal end side range such that the center point of said stub portions in the above-mentioned direction of plugging and unplugging forms a boundary therebetween, in the arranged state of the first terminals, impedance at arbitrary locations in the direction of plugging and unplugging within the free end side range is larger than impedance at arbitrary locations in the direction of plugging and unplugging within the proximal end side range.

2. The electrical connector assembly according to claim 1, wherein the contact arm portions of the first terminals comprise a configuration that tapers from the proximal end side to the free end side.

3. The electrical connector assembly according to claim 2, wherein the contact arm portions of the first terminals comprise a tapered configuration in which the dimensions of said first terminals in the array direction decrease in the above-mentioned direction of plugging and unplugging from the proximal end side to the free end side.

4. The electrical connector assembly according to claim 2, wherein the contact arm portions of first terminals comprise a configuration that tapers in the direction of plugging and unplugging from the proximal end side to the free end side when viewed in the direction of the terminal array.

5. The electrical connector assembly according to claim 3, wherein the contact arm portions of first terminals comprise a configuration that tapers in the direction of plugging and unplugging from the proximal end side to the free end side when viewed in the direction of the terminal array.

6. The electrical connector assembly according to claim 1, wherein some terminals among the plurality of first terminals are ground terminals.

7. The electrical connector assembly according to claim 2, wherein some terminals among the plurality of first terminals are ground terminals.

8. The electrical connector assembly according to claim 3, wherein some terminals among the plurality of first terminals are ground terminals.

9. The electrical connector assembly according to claim 4, wherein some terminals among the plurality of first terminals are ground terminals.

10. An electrical connector assembly wherein a first electrical connector, within at least a portion of an array range of a plurality of first terminals, is provided with ground plates disposed parallel to contact arm portions in said first terminals.

11. A first electrical connector utilized in an electrical connector assembly and configured to connect to a second electrical connector in a manner permitting plugging into and unplugging from each other, the first electrical connector comprising:

a plurality of first terminals arranged such that the array direction is a direction perpendicular to the direction of plugging and unplugging into/from the second electrical connector;

wherein said first terminals, in their free end portions located on the connector mating side, comprise contact arm portions extending in a rectilinear manner in the above-mentioned direction of plugging and unplugging;

and, when stub portions in the contact arm portions of the first terminals, which extend in the direction of plugging and unplugging from the locations of contact with the convex contact point portions of second terminals of the second connector to the free ends of said contact arm portions, are divided into a free end side range and a proximal end side range such that the center point of said stub portions in the direction of plugging and unplugging forms a boundary therebetween, in the arranged state of the first terminals, impedance at arbitrary locations in the direction of plugging and unplugging within the free end side range is larger than impedance at arbitrary locations in the direction of plugging and unplugging within the proximal end side range.

12. The first electrical connector according to claim 11, wherein the contact arm portions of the first terminals comprise a configuration that tapers from the proximal end side to the free end side.

13. The first electrical connector according to claim 11, wherein the contact arm portions of the first terminals comprise a configuration that tapers from the proximal end side to the free end side.

14. The first electrical connector assembly according to claim 11, wherein the contact arm portions of the first terminals comprise a tapered configuration in which the dimensions of said first terminals in the array direction decrease in the above-mentioned direction of plugging and unplugging from the proximal end side to the free end side.

15. The first electrical connector assembly according to claim 11, wherein the contact arm portions of first terminals comprise a configuration that tapers in the direction of plugging and unplugging from the proximal end side to the free end side when viewed in the direction of the terminal array.

16. The first electrical connector according to claim 13, wherein the contact arm portions of first terminals comprise a configuration that tapers in the direction of plugging and unplugging from the proximal end side to the free end side when viewed in the direction of the terminal array.

17. The first electrical connector according to claim 11, wherein some terminals among the plurality of first terminals are ground terminals.

18. The first electrical connector according to claim 12, wherein some terminals among the plurality of first terminals are ground terminals.

19. The first electrical connector according to claim 13, wherein some terminals among the plurality of first terminals are ground terminals.

20. The first electrical connector according to claim 14, wherein some terminals among the plurality of first terminals are ground terminals.

* * * * *